United States Patent [19]

Deutsch

[11] 4,421,002

[45] Dec. 20, 1983

[54] ADAPTIVE ACCOMPANIMENT TONE COLOR FOR AN ELECTRONIC MUSICAL INSTRUMENT

[75] Inventor: Ralph Deutsch, Sherman Oaks, Calif.

[73] Assignee: Kawai Musical Instrument Mfg. Co., Ltd., Hamamatsu, Japan

[21] Appl. No.: 344,093

[22] Filed: Jan. 29, 1982

[51] Int. Cl.[3] ..... G10H 1/36; G10H 7/00

[52] U.S. Cl. ..... 84/1.17; 84/DIG. 22

[58] Field of Search ..... 84/1.01, 1.03, 1.17, 84/DIG. 22

[56] References Cited

U.S. PATENT DOCUMENTS 4,205,576 6/1980 Deutsch et al. ..... 84/1.17

4,336,735 6/1982 Amano et al. ..... 84/1.17

*Primary Examiner*—Stanley J. Witkowski

*Attorney, Agent, or Firm*—Ralph Deutsch

[57] ABSTRACT

In a musical instrument having a solo and accompaniment keyboard apparatus is provided whereby an accompaniment tone color is generated which adaptively complements selected solo tones. The first zero crossing spacing of the autocorrelation function of the solo tones is computed and then used to generate the complementary accompaniment tones.

10 Claims, 9 Drawing Figures

ADAPTIVE ACCOMPANIMENT TONE COLOR FOR AN ELECTRONIC MUSICAL INSTRUMENT

BACKGROUND OF THE INVENTION

1. Field of the Invention

This invention relates to electronic tone synthesis and in particular is concerned with generating tones which complement preselected solo tones on an electronic musical instrument.

2. Description of the Prior Art

An electronic keyboard musical instrument, such as an electronic organ, is usually implemented with a number of tone switches for selecting the tones produced in response to actuated keyswitches. The tone switches are generally organized in groups which correspond to the tiers of keyboards each of which is composed of a linear array of keyswitches. Before starting to play such an instrument, the musician must confront the problem of selecting the combination of tone switches to be actuated for each of the keyboards. Since even a medium size instrument may contain about 10 tone switches per keyboard, the theoretical number of combinations of tone switches is $2^{10}-1=1023$ for each keyboard. Obviously the musician has a very large theoretical number of selection choices. Certain considerations, based upon a certain unspecified degree of musical maturity, are used to greatly reduce the number of tone stop combinations that are eligible for selection. However, even the use of emperical tone selection rules still leaves a very large number of residual switch selection choices.

Organs designed primarily for the performance of popular music are sometimes given the generic name of "entertainment" organs. These instruments are generally designed to use solo type voices on the upper keyboard (called the solo keyboard) and accompaniment type voices are available on the lower and pedal keyboards. A common tonal selection employed by the musican is to imitate a small combo group by selecting a solo stop for the upper keyboard along with a "blending" tone color on the lower keyboard and a similar blending tone for the pedal keyboard.

The choice of an accompaniment tone is, of course, ideally dependent upon the choice that has been made for the solo tones. Based upon years of experience with a wide variety of musical effects, some emperical rulse have been formulated for selecting accompaniment tones which complement a given solo tone. These rules are predicated upon a classification of organ tones. Before the rather recent advent of the tone synthesizer, organ tones were catagorized into four tone families comprising flutes, diapasons, strings, and reeds. These tone families are not sharply defined and the classification of a tone is somewhat subjective. A close examination of the tone classes indicates that the classes differ primarily in the number of prominent harmonics as well as with the rate at which the harmonic strengths decrease with increasing harmonic number.

The emperical tone selection rules are usually instructions for choosing a tone from a given class if the solo tone is selected from a specified class. These are not hard firm rules, but at least they provide a certain degree of guidance to the novice at tone selection.

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted to musical waveshapes. A sequence of computation cycles is implemented which comprises a solo tone computation cycle and an accompaniment tone computation cycle. During a solo computation cycle, a solo master data set is created by implementing a discrete Fourier transform using a set of harmonic coefficients which characterize the selected output solo musical sounds. During an accompaniment tone computation cycle an autocorrelation function is computed corresponding to the selected solo tone. A set of accompaniment harmonic coefficients is computed which complements the solo tone correlation function. An accompaniment master data set is then created by using a discrete Fourier transform using the set of accompaniment harmonic coefficients. At the end of a complete computation cycle the solo master data set is stored in a solo register and the accompaniment master data set is stored in an accompaniment register. The computations are carried out at a fast rate which may be nonsynchronous with any musical frequency.

Following a complete computation cycle, a transfer cycle is initiated during which the stored solo master data set is transferred to preselected members of a multiplicity of solo tone generators and the stored accompaniment master data set is transferred to preselected members of a multiplicity of accompaniment tone generators. The output tone generation of the musical instrument continues uninterrupted during the computation and transfer cycles. The transferred data are stored in a note register contained in each of the tone generators. The master data set stored in the note registers of the preselected members of the multiplicity of tone generators is sequentially and repetitively read out of storage and converted to an analog musical waveshape by means of a digital-to-analog converter. The memory addressing rate is proportional to the corresponding fundamental frequency of the musical pitch associated with a tone generator.

It is an object of the present invention to generate accompaniment tones which adaptively complement selected solo tones.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed to a subsystem for obtaining a set of accompaniment harmonic coefficients which adaptively complement a preselected solo tone combination which is incorporated into a musical tone generator of the type which snythesizes musical waveshapes by implementing a discrete Fourier transform algorithm. A tone geneeration system of this type is described in detail in U.S. Pat. No. 4,085,644 entitled "Polyphonic Tone Synthesizer" which is hereby incorporated by reference. In the following description all the elements of the system which are described in the referenced patent are identified by two digit numbers which correspond to the same numbered elements appearing in the referenced patent. All system element blocks which are identified by three digit numbers correspond to system elements added to the Polyphonic Tone Synthesizer to implement the improvements of the present invention to produce an adaptive accompaniment tone color in response to preselected solo musical tones.

A feature of the present invention is a means for catagorizing preselected solo tones by means of the autocorrelation functions corresponding to the solo tone waveforms. For a periodic waveshape, such as that produced by a tone generator in the system described in U.S. Pat. No. 4,085,644, the amplitude signal can be expressed by the real part of the complex relation $$x(t) = \sum_{n=-N}^{N} a_n \exp(i2\pi nt/T) \qquad \text{Eq. 1}$$

The corresponding autocorrelation function is defined by the following displaced function averaged over a period $$R(\tau) = 1/t \int_{-T/2}^{T/2} x(t+\tau)x^*(t)dt. \qquad \text{Eq. 2}$$

Eq. 1 and Eq. 2 can be combined to produce $$R(\tau) = \sum_{n=0}^{N} a_n^2 \cos(\pi n\tau/N). \qquad \text{Eq. 3}$$

It is noted that the autocorrelation function corresponding to a periodic function is also a periodic function of the same period as the original waveshape x(t). The shape of the autocorrelation function is not the same as that of the original time series, or signal, x(t). This change is apparent because the harmonic coefficients $a_n$ in Eq. 1 can have both positive and negative values while only the positive value of $a_n^2$ appears in Eq. 3.

Figure 1:
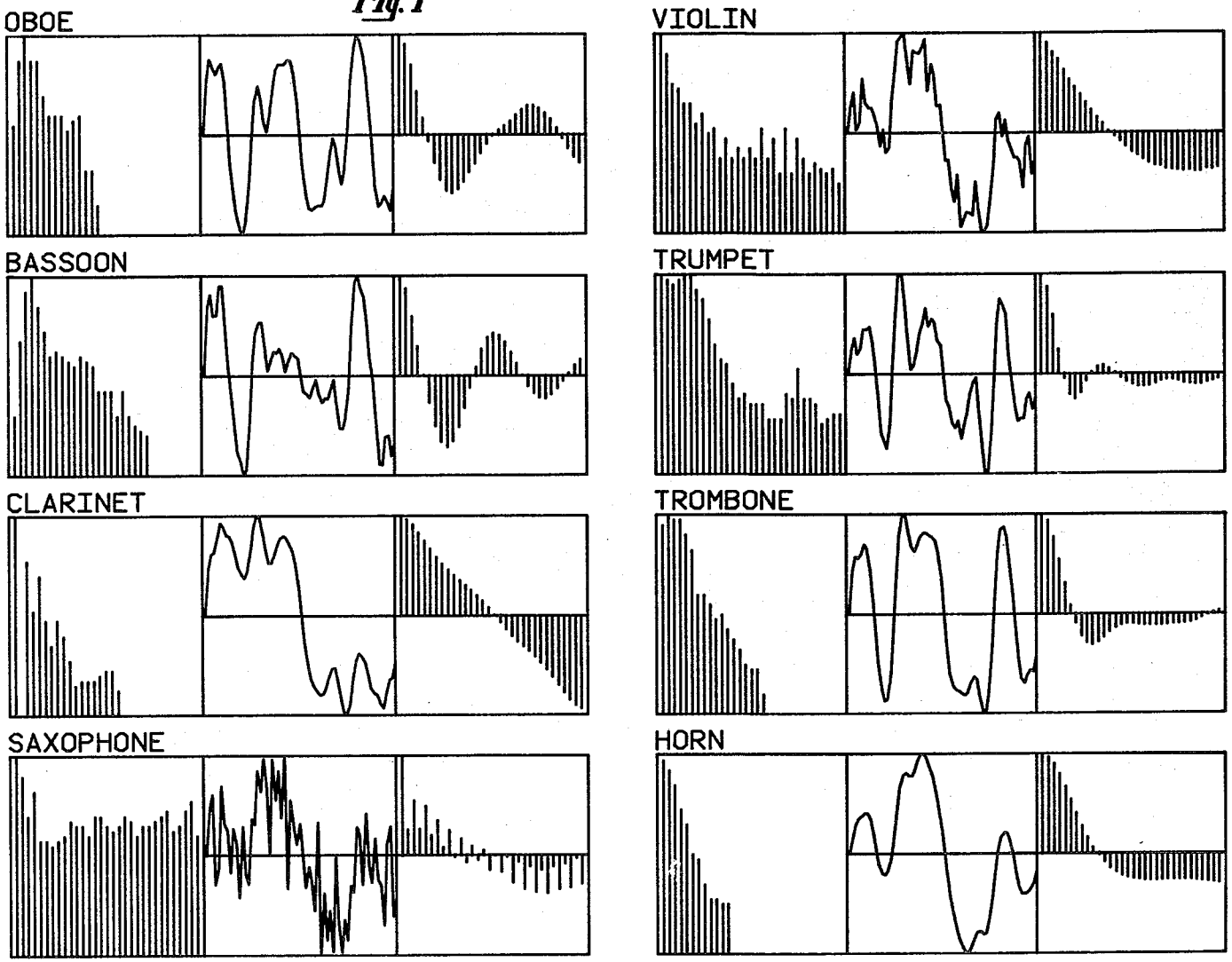
FIG. 1 is a set of musical waveshapes and their corresponding autocorrelation functions.

FIG. 1 illustrates some typical periodic musical waveshapes and their corresponding autocorrelation functions. In each case the left section is the set of 32 harmonic coefficients drawn in the range of 0 to 40 db. The middle section is the waveshape for one period of the musical signal. The right section is the autocorrelation function plotted for a normalized range of +1 to −1. An examination of FIG. 1 indicates that the autocorrelation functions are approximately of the well-known sin x/x functional shape. Moreover, the first zero of the autocorrelation function is a measure of the width of the corresponding tone spectra. A wide spectral width produces a small value of the autocorrelation displacement parameter $\tau$ for the first zero crossing. Conversely, a narrow spectral width produces a larger value of $\tau$ for the first zero crossing of the autocorrelation function.

Figure 2:
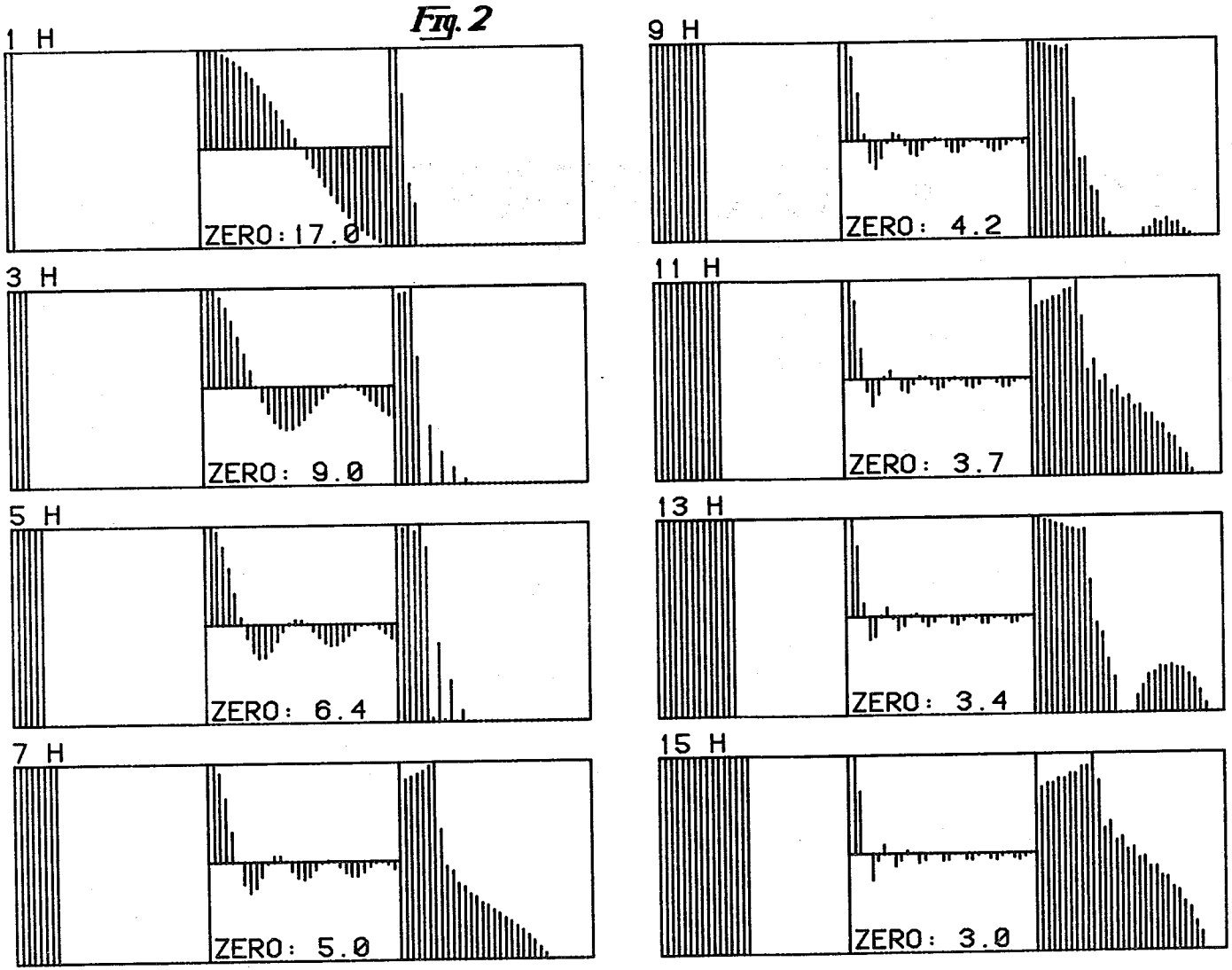
FIG. 2 illustrates the relation between the autocorrelation zero crossing and a corresponding spectra.

FIG. 2 illustrates the results of catagorizing a tone by means of a sin x/x function approximation to the autocorrelation function. In each case, from 1 to 15 harmonics in steps of 2, a wave shape was computed for the indicated number of equal harmonics. The autocorrelation function was computed for each waveshape to determine the displacement corresponding to the first zero crossing. A sin x/x curve was fitted to correspond to the crossing value. The zero crossing displacement is listed in each autocorrelation graph. The spectrum shown in the right section was obtained by the well-known method of computing the Fourier-cosine transform fo the autocorrelation function. It is noted that the resulting spectrum obtained by using an approximating curve for the true autocorrelation function is a good approximation to the original spectrum.

It is noted that the autocorrelation function is related to the autocovariance function used in mathematical statistics. If the waveshape has a zero mean (average) value then the autocorrelation function is equivalent to the autocovariance except for a normalizing constant. The waveshapes generated by the Polyphonic Tone Synthesizer, described in the referenced U.S. Pat. No. 4,085,644 are generated to have a zero mean value.

Figure 3:
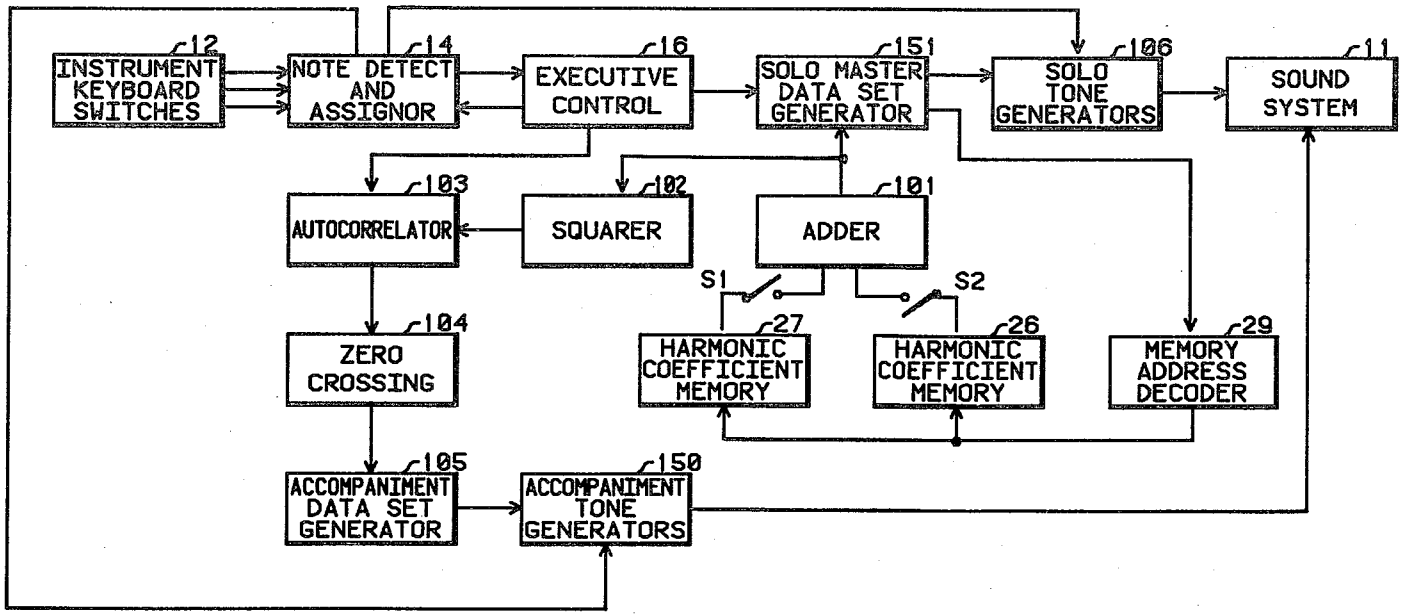
FIG. 3 is a schematic diagram of an embodiment of the invention.

FIG. 3 shows an embodiment of the present invention which is described as a modification and adjunct to the system described in U.S. Pat. No. 4,085,644. As described in the referenced patent, the Polyphonic Tone Synthesizer includes an array of switches. These are contained in the block labeled instrument keyboard switches 12 which, for example, correspond to the conventional keyboard linear array of switches for an electronic musical instrument such as an organ. If one or more keys are actuated ("on" position) on the instrument's keyboard, the note detect and assignor circuit 14 stores the corresponding note information for the actuated keyswitches and assigns one member of a set of twelve tone generators to each actuated keyswitch. The tone generators are divided into two groups. One group is used to generate the solo tones for keyswitches contained on the solo keyboard. This group is contained in the block labeled solo tone generators 106. The second group, contained in the block labeled accompaniment tone generators 150, is used to generate the accompaniment tones for keyswitches contained in the accompaniment keyboard. A suitable note detect and assignor subsystem is described in U.S. Pat. No. 4,022,098 which is hereby incorporated by reference.

When one or more keyswitches on the keyboards have been actuated, the executive control 16 initiates a computation cycle consisting of two subcycles. During the first subcycle of the computation cycle, a solo master data set consisting of 64 data words is computed by means of the solo master data set generator 151 and stored in a solo master data set memory. The 64 data words are generated using harmonic coefficients selected by the combination of switches S1 and S2 from values addressed out from the harmonic coefficient memories 26 and 27 in response to addresses furnished by the memory address decoder 29. The sum of the selected harmonic coefficients is provided to the solo master data set generator 151 by means of the adder 101. The 64 data words correspond to the amplitudes of 64 equally spaced points of one cycle of the audio waveform for the musical tone produced by the selected tone generators in the solo tone generators 106. The general rule is that the maximum number of harmonics in the audio tone spectra is no more than one half of the number of data points in one complete waveshape cycle or, equivalently, the number of data points comprising the master data set.

At the completion of the first subcycle of the computation cycle, a transfer cycle is initiated during which the solo master data set memory is transferred to note registers which are elements of each member of the set of tone generators contained in the solo tone generators 106. These note registers store the 64 data words which correspond to one complete cycle of a preselected musical tone. The data words stored in the note registers are read out sequentially and repetitively and transferred to a digital-to-analog converter which converts the digital data words into an analog musical waveshape. The musical waveshape is transformed into an audible sound by means of a sound system 11 consisting of a conventional amplifier and speaker subsystem. The stored data is read out of each note register at a rate corresponding to the fundamental frequency of the note corresponding to the actuated keyswitch to which a tone generator has been assigned.

As described in the referenced U.S. Pat. No. 4,085,644 it is desirable to be able to continuously recompute and store the generated master data sets during a sequence of computation cycles and to load this data into the note registers while the actuated keys remain depressed on the keyboards. This system function is accomplished without interrupting the flow of data points to the digital-to-analog converter at the read-out clock rates.

During the second subcycle of the computation cycle, in a manner described below, an accompaniment master data set is computed and stored in an accompaniment master data set memory contained within the accompaniment data set generator 105. The 64 data words comprising the master data set are generated in response to the first zero crossing of autocorrelation function of the selected solo tones. At the completion of the second subcycle of the computation cycle, a transfer cycle is initiated during which the accompaniment master data set stored in the accompaniment master data set memory is transferred to note registers which are elements of each member of the set of tone generators contained in the accompaniment tone generators 150. The data words stored in these note registers are transformed into audible sounds in the same manner as previously described for the solo tone generators.

The summed values of the selected solo harmonic coefficients from the output of the adder 101 are squared in magnitude by means of the squarer 102 which multiplies each input data value by itself. The output data from the squarer 102 is used by the autocorrelator 103 to compute the autocorrelation function corresponding to the selected harmonic coefficients for the solo tones. Autocorrelator 103 computes the autocorrelation function and the zero crossing 104 finds the location of the first zero crossing of the autocorrelation function. In response to the zero crossing of the autocorrelation function, the accompaniment data set generator 105 generates a set of accompaniment harmonic coefficients. Using this set of accompaniment harmonic coefficients, an accompaniment master data is generated which is used by the accompaniment tone generators assigned to keyswitch closures on the accompaniment keyboard.

Figure 4:
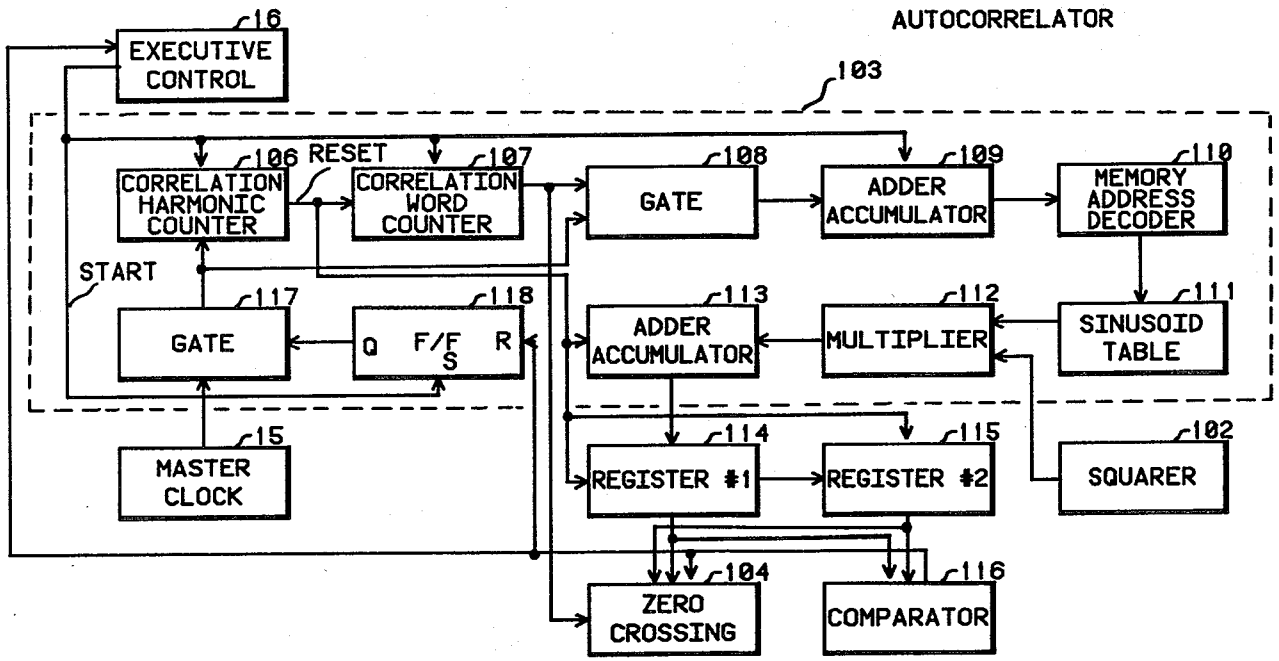
FIG. 4 is a schematic diagram of the autocorrelator 103.

FIG. 4 illustrates the system logic details for the autocorrelator 103. The autocorrelator 103 comprises all the illustrated logic blocks except for the master clock 15, squarer 102, register 114 and 115, zero crossing 104, and the comparator 116. At the start of a computation cycle, a START signal is generated by the executive control 16. The START signal sets the filp-flop 118 and resets the correlation harmonic counter 106 and the correlation word counter 107 to their initial count states.

The autocorrelator 103 is implemented to find the autocorrelation function by computing the discrete Fourier-cosine transform of the square of the harmonic coefficients. It is well-known in signal processing theory that the autocorrelation function is the Fourier-cosine transform of the power density spectral function. The power spectral density values, in this case, are the squared values of the harmonic coefficients.

When the flip-flop 118 is set, the gate 117 transfers timing signals from the master clock 15 to increment the count state of the correlation harmonic counter 106. The correlation harmonic counter 106 is implemented to count modulo 32. This number is selected to be equal to one-half of the number of data points in a master data set which corresponds to one period of a generated musical waveshape.

Each time that the correlation harmonic counter 106 returns to its initial count state because of its modulo counting implementation, it generates a RESET signal. This RESET signal is used to increment the correlation word counter 107. The correlation word counter 107 can be implemented to count modulo 64, and 64 is the highest theoretical count limit for the autocorrelation function spacing. However, as discussed below, the zero crossing of the autocorrelation function will always occur for a count state not exceeding 17. Thus, some economy is achieved by implementing the correlation word counter to count modulo 17.

Each time that the correlation harmonic counter 106 is incremented, gate 108 transfers the present count state of the correlation word counter 107 to the adder-accumulator 109. The adder-accumulator 109 adds the received data to the value previously accumulated to form an accumulated sum value. The accumulator contained in the adder-accumulator 109 is initialized to a zero value in response to the START signal provided by the executive control 16.

The memory address decoder 110 addresses out stored data values from the sinusoid table 111 in response to the accumulated sum value contained in the adder-accumulator 109. The sinusoid table 111 stores values of the trigonometric function cos ($\pi x/32$). x ranges in value from 0 to 63. The trigonometric value addressed out from the sinusoid table 111 is multiplied by the current data output from the squarer 102 by means of the multiplier 112. The product value, which is also called an autocorrelation component value, provided by the multiplier 112 is added to the data previously contained in the accumulator in the adder-accumulator 113 to form an accumulated summed value.

The adder-accumulator 113 is reset to an initial zero value each time that the correlation word counter 107 is incremented in response to the RESET signal generated by the correlation harmonic counter 106. Before the adder-accumulator 113 is reset by the RESET signal, the contents of register 114 is transferred to the register 115 and the content of the adder-accumulator 113 is transferred to the register 114.

The net result of the system operation described above, is that the register #1 114 contains the autocorrelation function value forthe state j of the correlation word counter 107 while the register #2 115 contains the autocorrelation function value corresponding to the state j-1 of the correlation word counter 107. The states of the correlation word counter 107 correspond to the displacement variable $\tau$ in Eq. 3.

At some displacement value $x_0$ there will exist a zero crossing of the autocorrelation function. Thus for some count state k, greater or equal to $x_0$ a positive number, or a zero value, will be contained in the register #2 115 while a negative number will exist in the register #1 114. The zero crossing displacement variable $x_0$ is not necessarily equal to any integer count state of the correlation word counter 107. The value of $x_0$ is computed from the count state k and the contents of the registers 114 and 115. The existence of a zero crossing of the autocorrelation function is determined by the comparator 116 while the zero crossing 104 calculates the value of $x_0$ for the correlation spacing parameter corresponding to the first zero crossing of the autocorrelation function.

Figure 5:
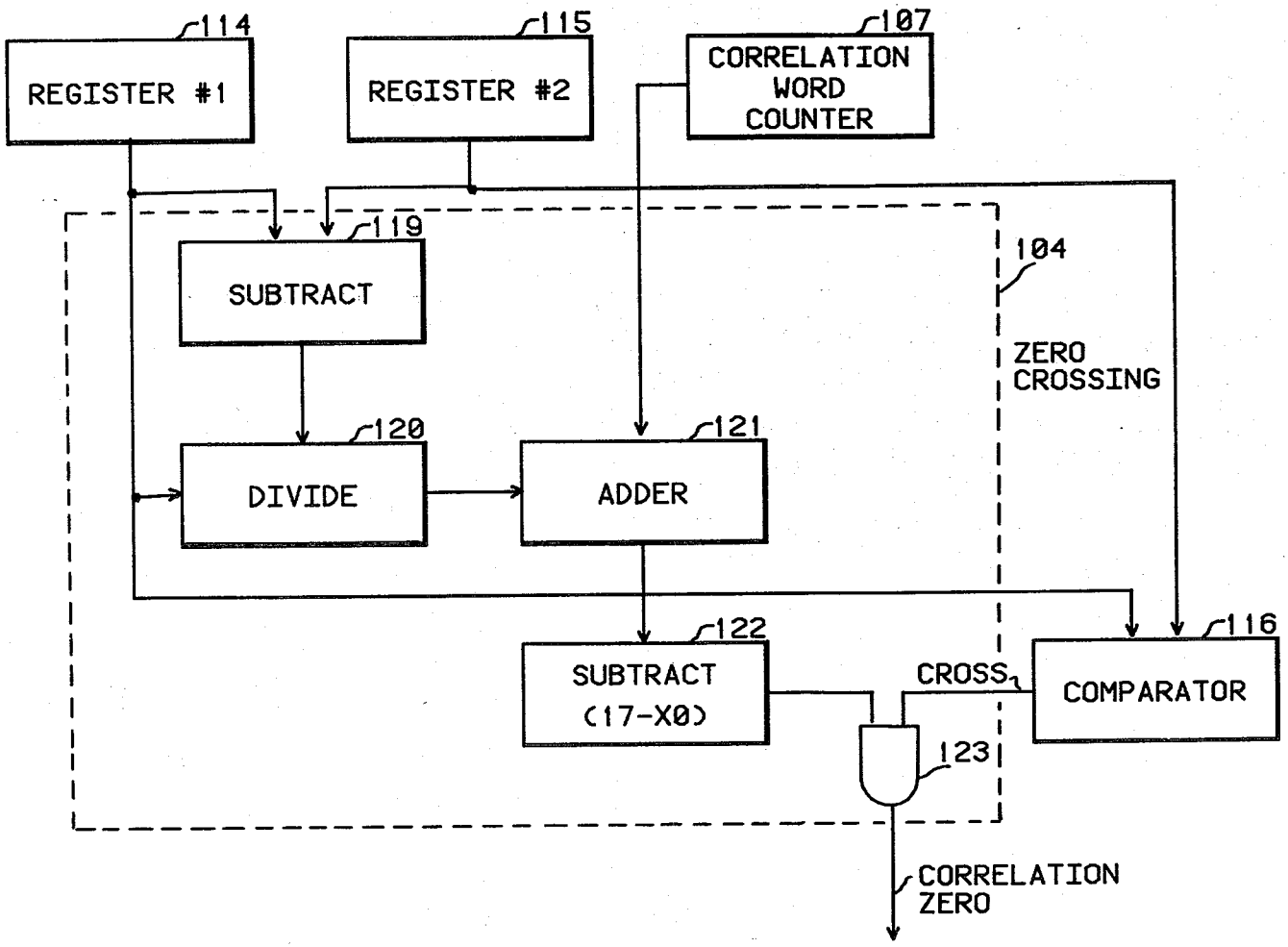
FIG. 5 is a schematic diagram of the zero crossing system block 104.

FIG. 5 illustrates the logic details for the system block zero crossing 104. The subtract 119 provides a register difference output value which is the difference of the data values contained in register #1 114 and register #2 115. The register difference value from the output of the subtract 119 is divided by the value contained in register #1 114 means of the divide 120. The output of the divide 120 is added to the current count state of the correlation word counter 107 to yield the value of $x_0$. It is recognized that $x_0$ is calculated by a linear interpolation process based upon the data values contained in registers 114 and 115.

The subtract 122 computes the value of $Z_0=17-x_0$. $Z_0$ is used as the first zero crossing of the autocorrelation function of the tone that will be adaptively generated for the accompaniment tones in response to the selected solo tones. The value of $Z_0$ is transferred by the AND-gate 123 in response to a CROSS signal which is generated by the comparator 116. The CROSS signal is generated by the comparator 116 when register #1 114 has a negative value and register #2 115 has a zero or positive value. While the AND-gate 123 is shown as a single gate, this is intended as a symbolic representation of a set of AND-gates equal in number to the number of data bits in the binary representation of the numerical value of $Z_0$.

Figure 6:
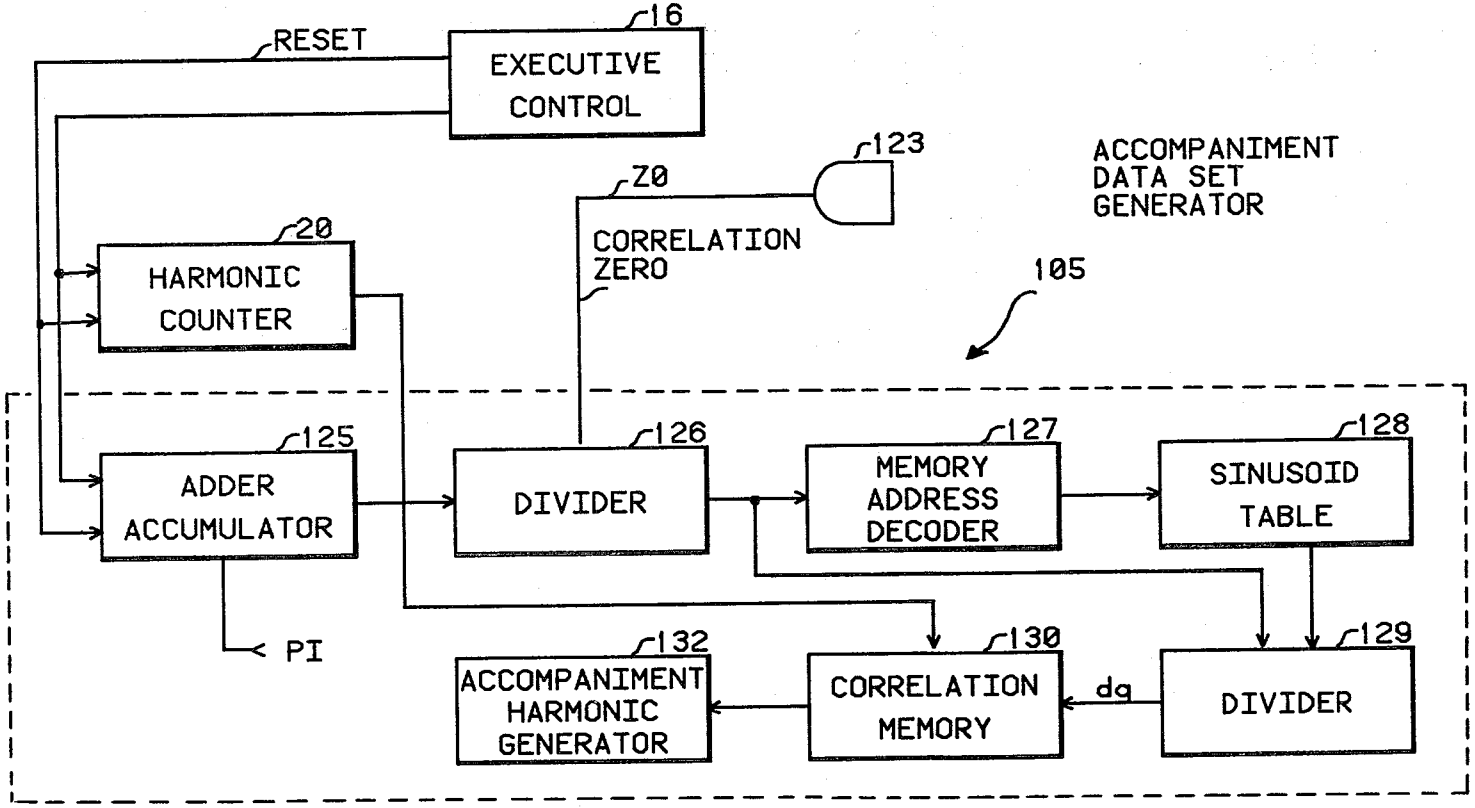
FIG. 6 is a schematic diagram of the accompaniment data set generator 105.

FIG. 6 shows the subsystem logic for computing an autocorrelation function of the form sin x/x having th previously determined value of $Z_0$ as its first zero crossing value. This subsystem is contained within the accompaniment data set generator 105. The system shown in FIG. 6 is similar to that described in U.S. Pat. No. 4,116,103 entitled "Pulse Width Modulation In A Digital Tone Synthesizer." This patent is hereby incorporated by reference.

Each time that the harmonic counter 20 is incremented by timing signals furnished by the executive control 16, adder-accumulator 125 adds the constant value of $PI=\pi$ to the contents contained in its accumulator. As described in the referenced U.S. Pat. No. 4,085,644, the harmonic counter 20 is a counter contained within the solo master data set generator 151. The accumulator in the adder-accumulator 125 is initialized to a zero value initial state each time a RESET signal is received from the executive control 16. This same RESET signal is used to reset the harmonic counter 20 to its initial count state. In this fashion, the adder-accumulator 125 has a content which is equal to the value $q\pi$, where q is the count state of the harmonic counter 20. The harmonic counter 20 is implemented to count modulo a number which is equal to one-half of the number of data points in a master data set.

The divider 126 divides the content of the adder-accumulator 125 by the zero crossing number $Z_0$ to provide the numeric quantity $q/Z_0$. The memory address decoder 127 addresses out stored data values from the sinusoid table 128 corresponding to the numeric value provided at the output of the divider 126. The sinusoid table 128 is implemented as an addressable memory storing values of the trigonometric function sin $(\pi q/Z_0)$. Divider 129 acts to divide the trigonometric value read out from the sinusoid table 128 by the value of $q\pi/Z_0$ provided by the divider 126. The net result is the numeric quantity $dq=\sin(\pi q/Z0/(\pi q/Z0)$. dq is the autocorrelation function value for a correlation displacement equal to q and for an autocorrelation function having its first zero crossing at the value of $Z_0$.

The generated values dq for the autocorrelation function are stored in the correlation memory 130 at an address location corresponding to the state q of the harmonic counter 20. The values of dq are used by the accompaniment harmonic generator 132 to compute a master data set to be used by the tone generators assigned to the lower, or accompaniment, keyboard.

Figure 7:
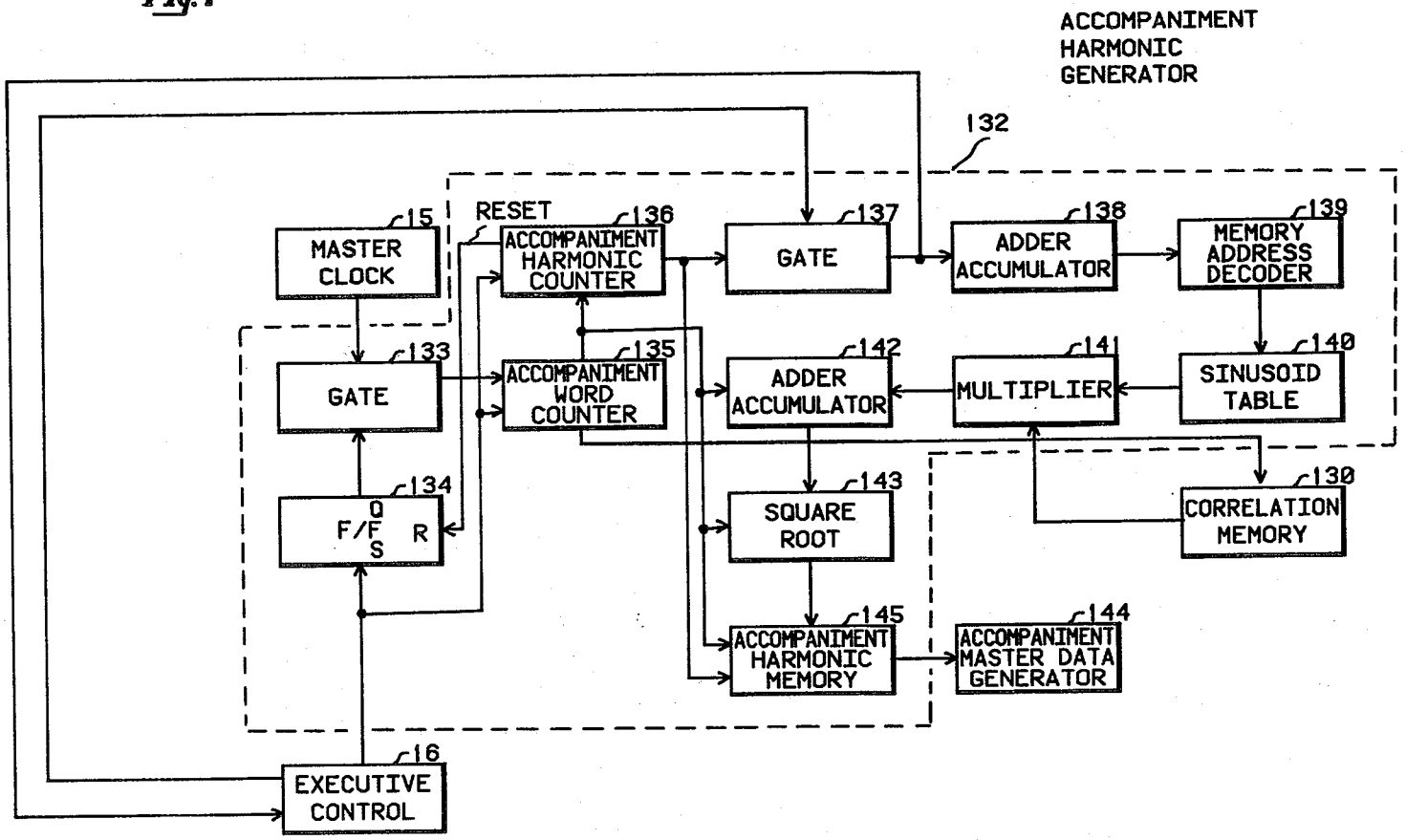
FIG. 7 is a schematic diagram of the accompaniment harmonic generator 132.

The logic details of the accompaniment harmonic generator 132 are shown in FIG. 7. The accompaniment harmonic generator 132 implements a discrete Fourier cosine transform to evaluate the squared values of the accompaniment harmonic coefficients from the values of the autocorrelation function stored in the correlation memory 130.

The flip-flop 134 is set by the executive control 16 at the start of an accompaniment computation cycle during which the harmonic coefficients to be used to compute an accompaniment master data set are computed from the autocorrelation function values dq stored in the correlation memory 130. When the flip-flop 134 is set, the count state of the accompaniment word counter 135 is reset to its initial, or zero, count state.

When the flip-flop 134 is set, its output logic state Q="1" causes the gate 133 to transfer timing signals furnished by the master clock 15. The timing signals transferred via the gate 133 are used to increment to count state of the accompaniment word counter 135. This counter is implemented to count modulo 32 which is equal to one-half of the number of data values in a master data set. Each time that the accompaniment word counter 135 returns to its initial count state, because of its modulo counting implementation, it generates a RESET signal.

The RESET signal generated by the accompaniment word counter 135 is used to increment the count state of the accompaniment harmonic counter 136. The accompaniment harmonic counter 136 is reset to its initial, or zero, count state at the start of an accompaniment computation cycle by means of a signal provided by the executive control 16.

The content, or state, of the accompaniment harmonic counter 136 is repeatedly added to the content of the accumulator in the adder-accumulator 138 at a rate determined by the master clock 15. The memory address decoder 139 reads out stored data values from the sinusoid table 140 corresponding to the content of the adder-accumulator 138. The sinusoid table 140 is implemented as a memory storing values of the trigonometric function sin ($\pi x/32$) which are addressed by values of the variable x.

Stored values of dq are read out from the correlation memory 139 in response to the count state of the accompaniment word counter 135. The read out values of dq are multiplied by the trigonometric function read out of the sinusoid table 140 by means of the multiplier 141.

The successive output values produced by the multiplier 141 are summed by means of the adder-accumulator 142 for the 32 count states produced by the accompaniment word counter 135. When the accompaniment word counter is reset because of its modulo counting implementation, a RESET signal is generated. In response to this RESET signal, the square root 143 evaluates the square root value corresponding to the current state of the content of the accumulator contained in the adder-accumulator 142. The evaluated square root data is stored in the accompaniment harmonic memory 145 at an address corresponding to the count state of the accompaniment harmonic counter 136.

The net result of the operation described above is that at the end of an accompaniment computation cycle, the accompaniment harmonic memory 145 will contain a set of 32 harmonic coefficients which are used by the accompaniment master data generator 144 to generate a master data set which is used as the primary tonal data input to the tone generators contained in the accompaniment tone generators 150 that are assigned to the lower, or accompaniment, keyboard.

When the accompaniment harmonic counter 136 returns to its initial count state because of its modulo counting implementation, a RESET signal is generated. This RESET signal is used to reset the flip-flop 134 thereby terminating an accompaniment computation cycle.

The accompaniment master data generator 144 creates an accompaniment master data set, using the harmonic coefficients stored in the accompaniment harmonic memory 145, in a manner exactly analogous to that previously described in the referenced U.S. Pat. No. 4,085,644 for generating a master data set.

Figure 8:
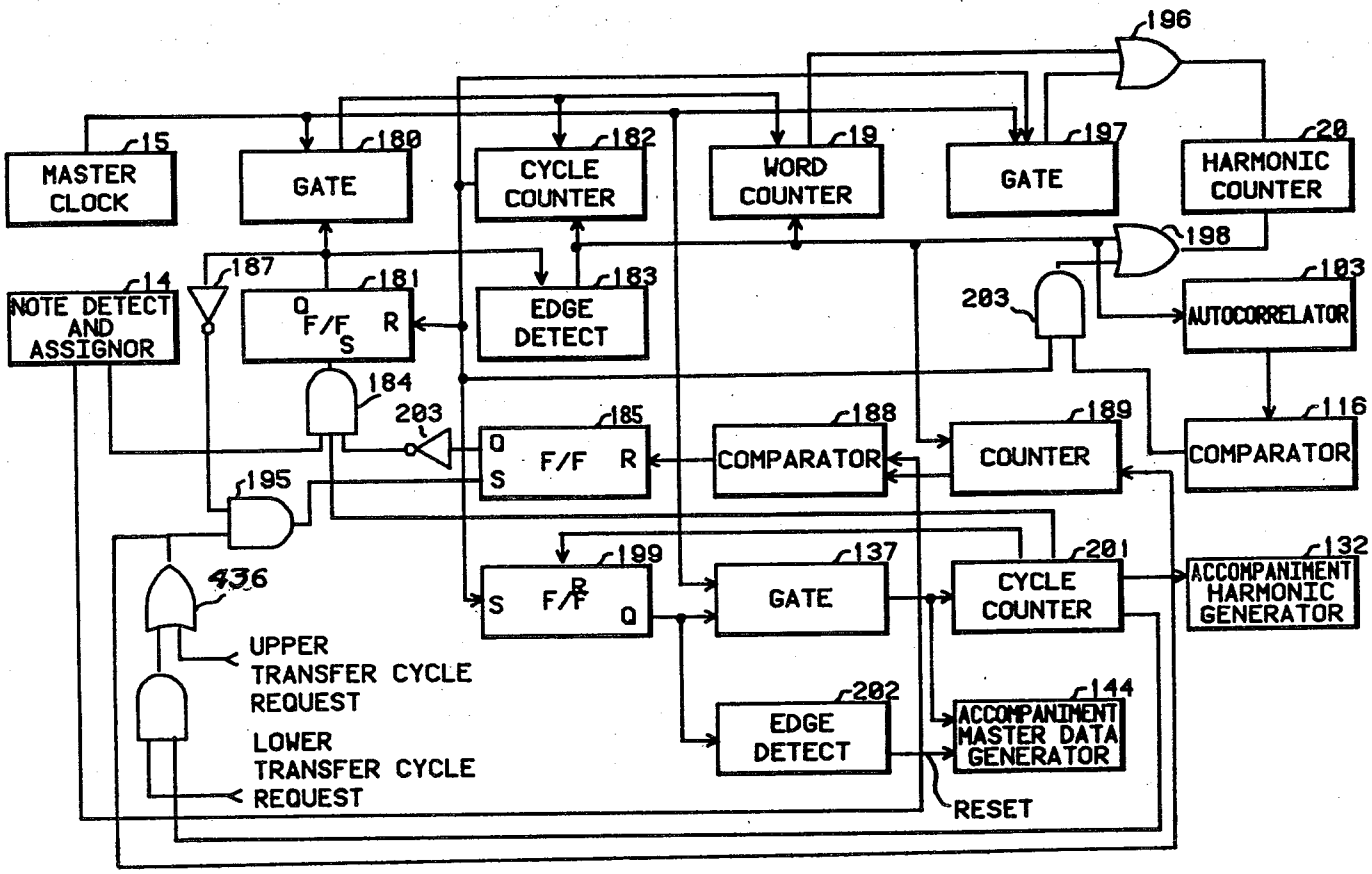
FIG. 8 is a schematic diagram of the executive control 16.

FIG. 8 shows an implementation for the system elements of the executive control 16. A complete computation cycle is initiated when flip-flop 181 is set so that its output logic state is Q="1". Flip-flop 181 can be set in response to a signal from the note detect and assignor if flip-flop 185 has its output state a logic Q="0" and if the cycle counter 194 has reached its maximum count state. As described below, flip-flop 185 is used to control a transfer cycle and it is desirable that a new computation cycle not be initiated until the transfer cycle has been completed. Note detect and assignor 14 will generate a request for the start of a computation cycle if this subsystem has detected that a keyswitch has been actuated on the musical instrument's keyboard. An alternative logic is to always initiate a complete computation cycle when a transfer cycle is not in progress, or to initiate a computation cycle at the completion of each transfer of a master data set to one of the assigned tone generators.

When flip-flop 181 is set at the start of a computation cycle, the output state Q="1" is converted into a signal pulse, labeled START, by means of the edge detect circuit 183. As described in the referenced U.S. Pat. No. 4,085,644 the START signal is used to initialize the word counter 19 and the harmonic counter 20. The START signal is also provided to the autocorrelation 103.

The logic state Q="1" causes gate 180 to transfer clock timing signals from the master clock 15 to increment the cycle counter 182 and the word counter 19.

During the first portion of the computation cycle for which a master data set is computed for the solo tone generators assigned to the upper, or solo keyboard, cycle counter 182 counts a total of $64 \times 32 = 2048$ master clock timing signals. This number is the product of the number of data words in a master data set multiplied by the maximum number of harmonic coefficients used to construct a selected musical tone. When the cycle counter 182 reaches its maximum count state, a signal is generated which resets the flip-flop 181.

The word counter 19 is implemented to count modulo 64 which is equal to the number of data words in a master data set. Each time that the word counter 19 returns to its initial state because of its modulo counting implementation a RESET signal is generated. This RESET signal is supplied via the OR-gate 196 to increment the count state of the harmonic counter 20 during the segment of the computation cycle during which a master data set is computed and stored in the main register 34 in the fashion described in the referenced U.S. Pat. No. 4,085,644.

A number equal to the total number of assigned solo and accompaniment tone generators is transmitted to the comparator 188 from the note detect and assignor 14. Counter 189 is incremented by the transfer cycle requests that appear at the output of OR-gate 436. The transfer cycle requests for the assigned accompaniment tone generators, labeled as lower transfer cycle request, are inhibited from incrementing the counter 189 until the cycle counter 201 has reached its maximum count state at which time a master data has been computed to be used by the assigned accompaniment tone generators. AND-gate 204 accomplishes the function of inhibiting the lower transfer cycle requests until the accompaniment master data set has been computed. Counter 189 is reset to an initial count state at the start of a computation cycle by the signal produced by the edge detect 181.

When the comparator 116 indicates that the first zero crossing of the solo tone's autocorrelation function has been detected, a signal is sent to the AND-gate 203. A second signal is sent to AND-gate 203 when the cycle counter 182 has reached its maximum count state. AND-gate 203 will then reset the harmonic counter 20 to its initial count state. At the same time, gate 197 will transfer the timing pulses from the master clock 15 via OR-gate 196 to increment the state of the harmonic counter 20.

When the cycle counter 182 reaches its maximum count state, the generated signal that resets the flip-flop 181 is used to set the flip-flop 199. Setting flip-flop 199 initiates the portion of the computation cycle during which the accompaniment harmonic coefficients are computed and during which the accompaniment master data is computed.

When flip-flop 199 is set, its output logic state Q="1" causes gate 137 to transfer timing pulses from the master clock 15 which are used to increment the state of the cycle counter 201. The logic Q="1" signal is converted to a signal pulse by means of the edge detect 202 and furnished as an initializing signal to the accompaniment master data generator 144.

The cycle counter 201 is implemented to count modulo $32+(64\times32)+(64\times32)$. The first term, 32, is the number of timing signal pulses required to compute the 32 values of the set of harmonic coefficient dq by means of the accompaniment data set generator 105. At count state 33, a signal is transmitted from the cycle counter 201 which is used to set the flip-flop 134 which is an element of the accompaniment harmonic generator 132. At the end of its maximum count, cycle counter 201 generates a signal which is furnished as an input to the AND-gate 184. At this time the system is ready to start a new computation cycle as soon as the comparator 188 indicates that all the transfer cycle requests have been fulfilled.

Figure 9:
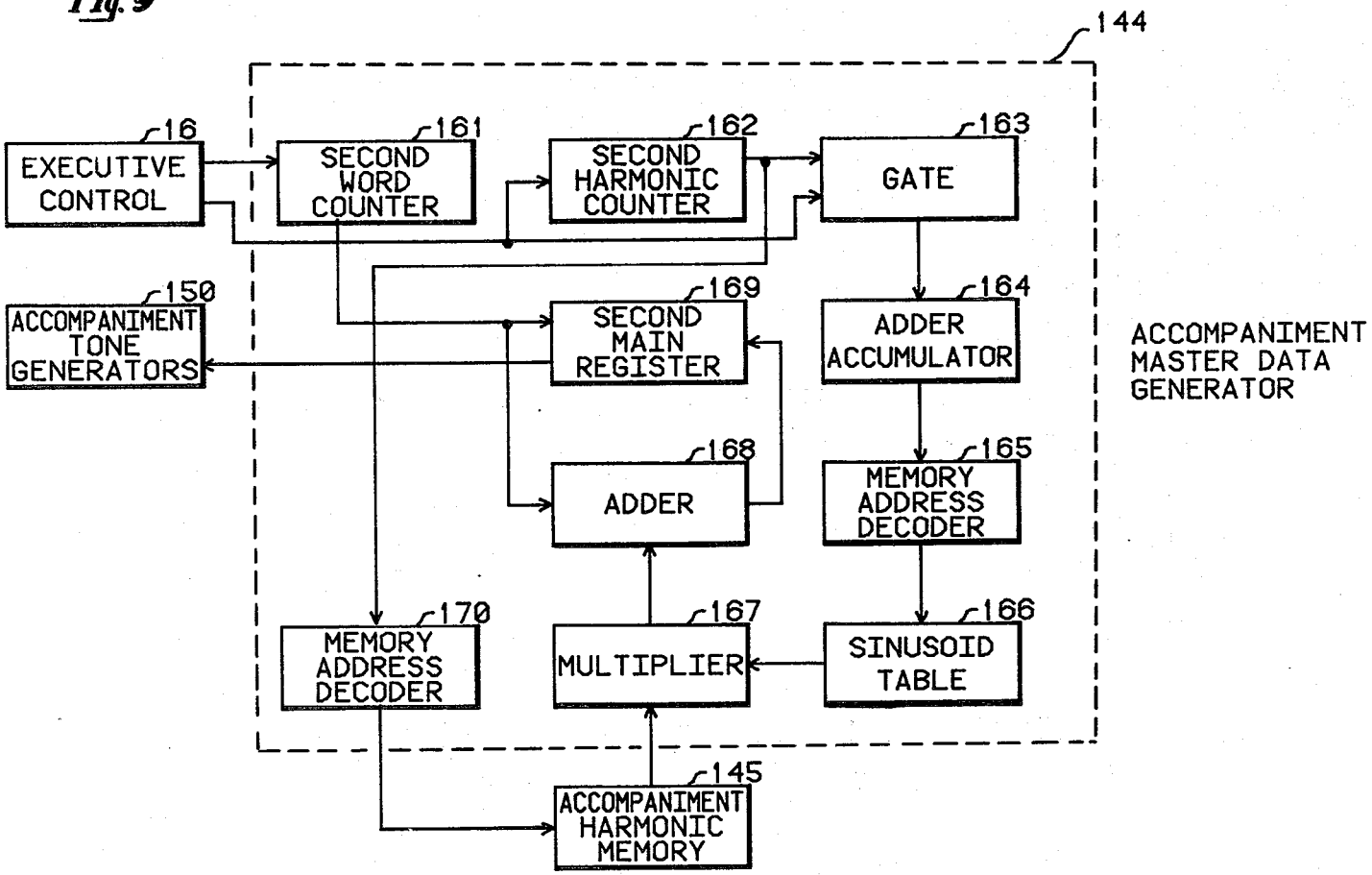
FIG. 9 is a schematic diagram of the accompaniment master data generator 144.

FIG. 9 shows the details of the accompaniment master data generator 144. This subsystem operates in a manner analogous to the system elements shown in FIG. 3 which are used to generate the master data set for the solo tone generators 106. This operation is described in the referenced U.S. Pat. No. 4,085,644. The equivalent subsystem blocks are the pairs 19-161, 20-162, 22-163, 21-164, 23-165, 14-166, 28-167, 33-168, 34-169, 25-170, 27,26-145. The accompaniment master data is computed and stored in the second main register 169. This master data is transferred to memories located within the set of accompaniment tone generators 150 and converted into musical tones in the manner described in the referenced U.S. Pat. No. 4,085,644.

A variety of modifications are readily implemented for the described implementation of the invention. Instead of computing the zero of the accompaniment autocorrelation as $17-x_0$, other expressions can be used such as $Z_0=K-f(X_0)$ where K is a specified constant and $f(x_0)$ is a function of the zero crossing value $x_0$. For example the expression $Z_0=K-A\exp(Bx_0)$ provides a useful result for various selected values of the constants K, A, B.

I claim:

1. In a keyboard musical instrument having a solo keyboard comprising a solo linear array of keyswitches and having an accompaniment keyboard comprising an accompaniment linear array of keyswitches wherein a number of solo tone generators associated with said solo keyboard produce musical waveshapes from a solo master data set having a plurality of data words defining the waveform of a solo musical tone are computed and transferred sequentially to a digital-to-analog converter to be converted into musical waveshapes and wherein a number of accompaniment tone generators associated with said accompaniment keyboard produce musical waveshapes from an accompaniment master data set having a plurality of data words defining the waveform of an accompaniment musical tone are computed and transferred sequentially to a digital-to-analog converter to be converted into musical waveshapes, apparatus for generating accompaniment musical tones which complement a selected solo musical tone comprising:

a coefficient memory for storing a set of solo harmonic coefficient values, a harmonic coefficient addressing means for reading out solo harmonic coefficient values from said coefficient memory, a first means for computing, responsive to solo harmonic coefficient values read out from said coefficient memory, whereby said selected solo master data set comprising a plurality of data points defining a solo musical tone is computed, a solo means for producing said selected solo musical tones from said solo master data set in response to keyswitches actuated in said solo linear array of keyswitches, a second means for computing, responsive to said solo harmonic coefficient values read out from said coefficient memory, whereby a set of autocorrelation function data values are computed, a third means for computing, responsive to said set of autocorrelation function data values, whereby a set of accompaniment harmonic coefficient values are computed, a fourth means for computing, responsive to said set of accompaniment harmonic coefficient values, whereby said accompaniment master data set comprising a plurality of data points defining an accompaniment musical tone is computed, and an accompaniment means for producing said accompaniment musical tones in response to keyswitches actuated in said accompaniment linear array of keyswitches, which complement said selected solo musical tones, from said accompaniment master data set.

2. In a musical instrument according to claim 1 wherein said second means for computing comprises:

a squarer means, responsive to said solo harmonic coefficient values read out from said coefficient memory, whereby each of said solo harmonic coefficient values is multiplied by itself thereby producing a power coefficient value, a clock means for providing timing signals, a first counter means for counting said timing signals modulo a specified number M and wherein a first reset signal is generated when said first counter means returns to its initial count state, a second counter means incremented by said first reset signal, wherein said second counter means counts modulo a specified number N, a first adder-accumulator means for successively adding contents of said second counter means to a sum value contained in said first adder-accumulator means, a first sinusoid table for storing a set of trigonometric function values, a first addressing means, responsive to contents of said adder-accumulator means, whereby a trigonometric function value is read out from said first sinusoid table, a first multiplier means for multiplying said trigonometric function value read out from said first sinusoid table by said power coefficient value to create an autocorrelation function component value, means for accumulating each said autocorrelation function component value thereby generating a sequence of autocorrelation function values, and a zero crossing means, responsive to said autocorrelation function values, whereby a zero crossing signal is generated when one of said sequence of autocorrelation function values has a positive numerical value and is followed in sequence by one of said sequence of autocorrelation function values which has a negative or zero numerical value.

3. In a musical instrument according to claim 2 wherein said third means for computing comprises:

a zero crossing computing means, responsive to said sequence of autocorrelation function values, wherein a complementary zero crossing spacing value is computed in response to said zero crossing signal, and an accompaniment harmonic generator, responsive to said complementary zero crossing spacing value, wherein said set of accompaniment harmonic coefficient values are computed.

4. In a musical instrument according to claim 3 wherein said accompaniment harmonic generator comprises:

a second adder-accumulator means, responsive to said first reset signal, whereby the value of PI=3.14159 is successively added to a sum value contained in said second adder-accumulator means, a first divider means wherein said sum value contained in said second adder-accumulator means is divided by said complementary zero crossing spacing value to form an argument data value, a second sinusoid table for storing a set of trigonometric function values, a second addressing means, responsive to said argument data value, whereby a trigonometric function value is read out from said second sinusoid table, a second divider means wherein said trigonometric value read out from said second sinusoid table is divided by said argument data value to form an accompaniment harmonic coefficient value, an accompaniment coefficient memory, and a third addressing means, responsive to the count state of said second counter means, whereby said accompaniment harmonic coefficient value produced by said second divider means is stored in said accompaniment coefficient memory thereby producing said set of accompaniment harmonic coefficient values.

5. In a musical instrument according to claim 3 wherein said zero crossing means comprises:

a first register means for storing one of said sequence of autocorrelation function values, a second register means for storing an autocorrelation function value, a transferring means for transferring an autocorrelation function value from said first register means to said second register means, a subtracting means whereby a difference value is generated by subtracting the contents of said second register means for the contents of said first memory means, an interpolation means, responsive to said difference value, wherein a zero crossing spacing value is generated, and a complementary generator means whereby said complementary zero crossing signal is generated in response to said zero crossing spacing value.

6. In a keyboard musical instrument having a solo keyboard comprising a solo linear array keyswitches and having an accompaniment keyboard comprising an accompaniment linear array of keyswitches and wherein a number of solo tone generators associated with said solo keyboard produce musical waveshapes from a plurality of solo data words defining the waveform of a solo musical tone are computed and transferred sequentially to a digital-to-analog converter to be converted into solo musical waveshapes and wherein a number of accompaniment tone generators associated with said accompaniment keyboard produce musical waveshapes from a plurality of accompaniment data words defining the waveform of an accompaniment musical tone are computed and transferred sequentially to a digital-to-analog converter to be converted into musical waveshapes, apparatus for generating accompaniment musical tones which complement a selected solo musical tone comprising:

a coefficient memory for storing a plurality of sets of solo harmonic coefficient values, a plurality of tone switches wherein each setting of the tone switches corresponds to a choice of said selected solo musical tone, a first addressing means responsive to the setting of said plurality of tone switches for reading out a corresponding selected set of solo harmonic coefficient values from said coefficient memory, a solo computing means, responsive to said selected set of solo harmonic coefficient values, for generating and storing a solo master data set having data values corresponding to a succession of points for said selection of a predetermined solo musical tone, an autocorrelation computing means wherein a set of autocorrelation function values are computed in response to said selected set of solo harmonic coefficient values read out from said coefficient memory, an accompaniment harmonic coefficient means, responsive to said set of autocorrelation function values, wherein a set of accompaniment harmonic coefficient values are computed, an accompaniment computing means, responsive to said set of accompaniment harmonic coefficient values, for generating and storing an accompaniment master data set having data values corresponding to a succession of points corresponding to said accompaniment musical tone, a solo production means for producing said predetermined musical tone from said stored solo master data set in response to keyswitches actuated in said solo linear array of keyswitches, and an a ccompaniment production means, responsive to said accompaniment master data set and responsive to keyswitches actuated in said accompaniment linear array of keyswitches, for producing said accompaniment musical tones which complement said selected solo musical tone.

7. In a musical instrument according to claim 6 wherein said solo production means comprises:

a plurality of solo registers, solo transferring means responsive to the setting of any of the keyswitches contained in said solo linear array of keyswitches, whereby said stored solo master data set is transferred to selected members of said plurality of solo registers, a plurality of variable frequency solo clock generators each associated with a member of said plurality of solo registers whereby said transferred solo master data set is read out at a selected clock rate, and solo digital-to-analog converter means whereby said solo master data set read out from said plurality of solo register is converted to produce musical tones corresponding to said selected solo musical tone.

8. In a musical instrument according to claim 6 wherein said accompaniment production means comprises:

a plurality of accompaniment registers, accompaniment transferring means resposive to the setting of any of the keyswitches contained in said accompaniment linear array of keyswitches, whereby said accompaniment master data set is transferred and stored in selected members of said plurality of accompaniment registers, a plurality of variable frequency accompaniment clock generators each associated with a member of said plurality of accompaniment registers whereby the contents stored in said accompaniment registers is read out at a selected clock rate, and accompaniment digital-to-analog converter means whereby said accompaniment master data set read out from said plurality of accompaniment registers is converted to produce said accompaniment musical tones which complement said select solo musical tone.

9. A musical instrument according to claim 6 wherein said autocorrelation means comprises:

interpolation means whereby a zero crossing correlation spacing number is computed from said set of autocorrelation values corresponding to an algebraic sign change between consecutive values of said set of autocorrelation values.

10. A musical instrument according to claim 8 wherein said accompaniment harmonic coefficient means comprises:

a correlation function generator whereby a set of accompaniment autocorrelation function values are generated in response to said zero crossing spacing number, and a coefficient computing means whereby said set of accompaniment harmonic coefficient values are computed from said set of accompaniment autocorrelation function values.

* * * * *